United States Patent [19]

Schlecht

[11] Patent Number: 4,893,992

[45] Date of Patent: Jan. 16, 1990

[54] TWO-CYLINDER THICK-MATERIAL PUMP

[75] Inventor: Karl Schlecht, Stuttgart, Fed. Rep. of Germany

[73] Assignee: Putzmeister-Werk Maschinenfabrik GmbH, Aichtal, Fed. Rep. of Germany

[21] Appl. No.: 210,849

[22] Filed: Jun. 24, 1988

[30] Foreign Application Priority Data

Jun. 27, 1987 [DE] Fed. Rep. of Germany ..... 3721248

[51] Int. Cl.[4] ..... F04B 19/00; F04B 39/10

[52] U.S. Cl. ..... 417/238; 417/517; 417/900

[58] Field of Search ..... 417/203, 206, 238, 516, 417/517, 519, 454, 532, 533, 900; 92/59; 415/128, DIG. 3

[56] References Cited

U.S. PATENT DOCUMENTS

| | | | |
|---|---|---|---|
| 3,380,388 | 4/1968 | Sherrod | 417/344 |
| 3,465,685 | 9/1969 | Sherrod | 417/900 |
| 4,526,520 | 7/1985 | Henderson | 417/900 |

*Primary Examiner*—Leonard E. Smith
*Assistant Examiner*—Robert N. Blackmon
*Attorney, Agent, or Firm*—Horst M. Kasper

[57] ABSTRACT

The invention relates to a two-cylinder piston pump with a pre-compression device for concrete, slurry, and the like material. This pump has the advantage over the pumps known in the art that the pre-compression unit (3) can be flanged on at the hopper (1) in any desired angle relative to the transport cylinders (4, 4').

18 Claims, 3 Drawing Sheets

TWO-CYLINDER THICK-MATERIAL PUMP

BACKGROUND OF THE INVENTION

1. Field of the Invention

The invention relates to a two-cylinder piston pump with a pre-compression device for concrete, slurry, and the like material.

2. Brief Description of the Background of the Invention Including Prior Art

Thick-material pumps include pumps for concrete, slurry, sludge, slime, mine refill, and the like viscous material. Pre-compression devices can be attached to such thick-material pumps as taught, for example, in U.S. Pat. No. 3,465,685, which is hereby incorporated by reference in this application. The pre-compression devices preferably comprise one-shaft or two-shaft conveyor screws and are flanged at one side of the feed chamber or hopper exhibiting the pipe switch. This can prove disadvantageous at the time of placing these devices or in case of their incorporation in spaces with predetermined dimensions.

SUMMARY OF THE INVENTION

1. Purposes of the Invention

It is an object of the invention to provide a thick-material pump which can be better adapted to positioning despite a projecting pre-compression unit than is the case with conventional pumps.

It is another purpose of the present invention to provide a sludge pump which can be better adapted to an incorporation in preset spatial conditions.

It is yet another purpose of the present invention to provide a sludge pump which is of modular construction and allows easy replacement of the various parts and sections.

These and other objects and advantages of the present invention will become evident from the description which follows.

2. Brief Description of the Invention

According to the invention there is provided a two-cylinder thick-material pump. A feed chamber or hopper has a wall and several locations with openings in the wall. Transport cylinders are connected to the hopper. A transport line is provided for pumped output. A precompression unit, comprising at least one conveyor worm, is flanged to one of the openings in the wall of the hopper, and covers are covering the other openings in the wall of the hopper. A pipe switch is tiltably disposed at the hopper and alternatingly connects the transport cylinders with the transport line and with the pre-compression unit. The precompression unit is flangable by choice to different openings in the wall of the hopper for allowing a positioning of transport cylinders and pre-compression unit at different angles relative to each other.

A movable cover plate can be attached at the hopper.

A hopper includes a first part of the hopper and a second part of the hopper. Said second part of the hopper is flanged to the first part of the hopper. Transport cylinders are connected to the first part of the hopper. A pre-compression unit is attached to the second part of the hopper. A transport line is provided for the pumped output. A pipe switch is tiltably disposed at the hopper, received at the first part of the hopper, and is alternatingly connecting the transport cylinders with the transport line and with the pre-compression unit. The first and the second parts of the hopper are flangable by choice in different directions to each other for allowing positioning of transport cylinders and pre-compression unit at different angles relative to each other.

The second part of the hopper, supporting the pre-compression unit, can be connected with the first part receiving the pipe switch via a horizontal flange. The horizontal flange, connecting the first part and the second part to each other, can be formed as a circle or as a square.

The second part supporting the pre-compression device can form the lower part of the hopper. The hopper can comprise a movable cover plate.

The first part of the hopper, receiving the pipe switch, can comprise an upper and lower horizontal flange. The second part, carrying the pre-compression unit and the cover plate, can be exchanged relative to the first part as desired.

According to one embodiment of the invention, the hopper exhibits at several sides openings which can be covered and at which openings the pre-compression unit can be flanged on as desired. The sludge pumps according to the invention are provided with a hopper which is tiltably disposed, where a pipe switch connects the transport cylinders alternatingly with a conveyor line and with a precompression unit flanged onto the wall of the hopper, which pre-compression unit comprises at least a conveyor screw and which pre-compression unit is connected to a filling funnel.

According to another aspect of the invention, the pre-compression unit is attached to a part of the hopper, which can be flanged onto the other part of the hopper receiving the pipe switch in different directions. Advantageously, the part of the hopper carrying the precompression unit can be connected via a horizontal flange with the other part accepting the pipe switch, where the part carrying the pre-compression unit forms advantageously the lower part of the hopper. If the flange connecting the two parts to each other is formed like a square, then the pre-compression unit can be brought into different directions relative to the transport cylinders by rotation of respectively 90 degrees. In case of using a circular flange, any desired intermediate position is also possible.

According to a further advantageous embodiment of the invention, the hopper is provided with a cover plate which can be removed or can be tilted away, i.e. with a movable cover plate. For this purpose, if the part of the hopper receiving the pipe switch contains an upper and a lower horizontal flange, having respectively the same dimensions. The parts supporting the pre-compression unit and the cover plate, respectively, can be exchanged against each other as desired. A cover plate lying at the bottom would have the advantage that the hopper would be better accessible for cleaning purposes, and the exchange of the parts subject to wear would be easier.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
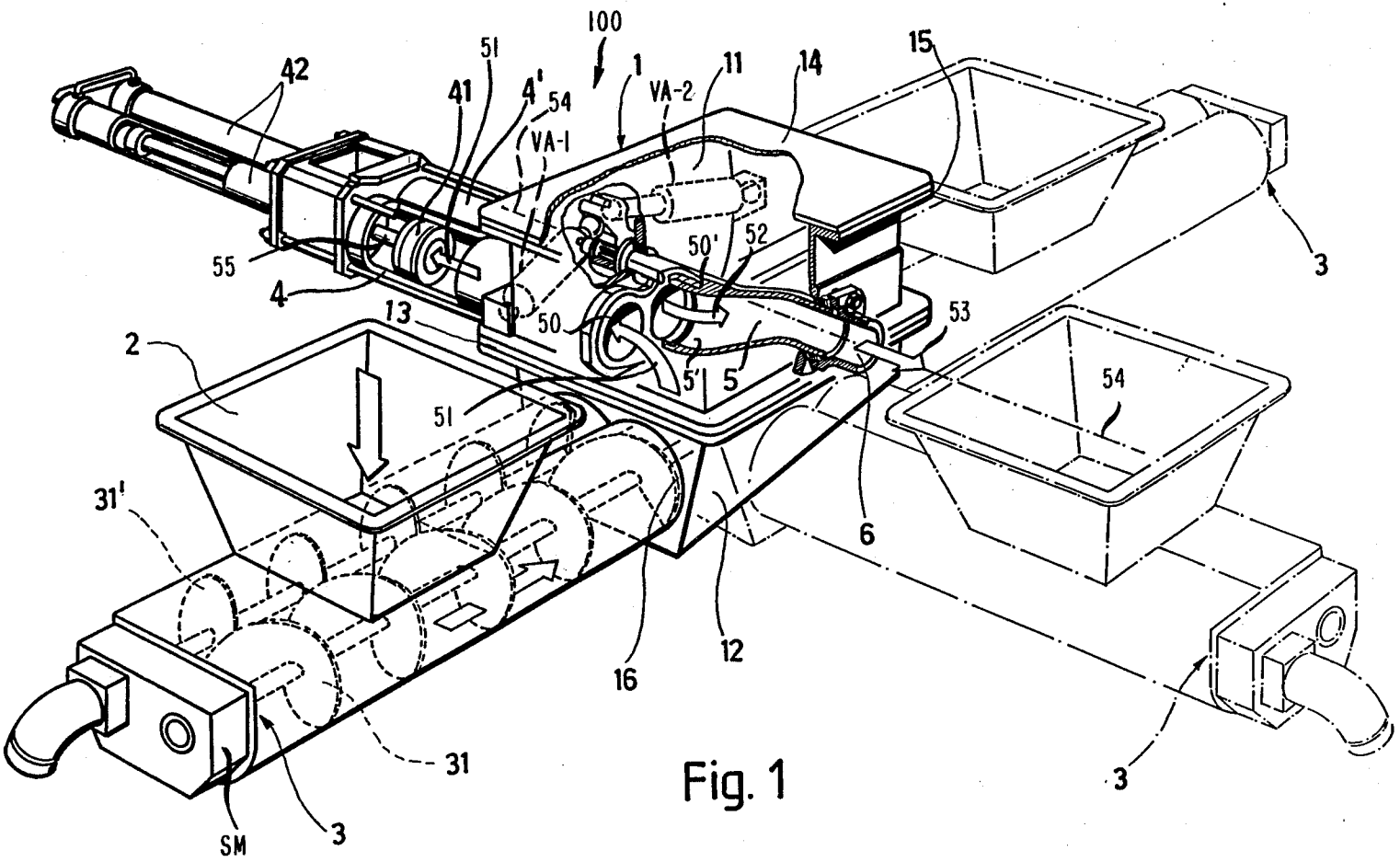
FIG. 1 is a schematic perspective view representation of a thick-material pump with a precompression
Figure 1A:
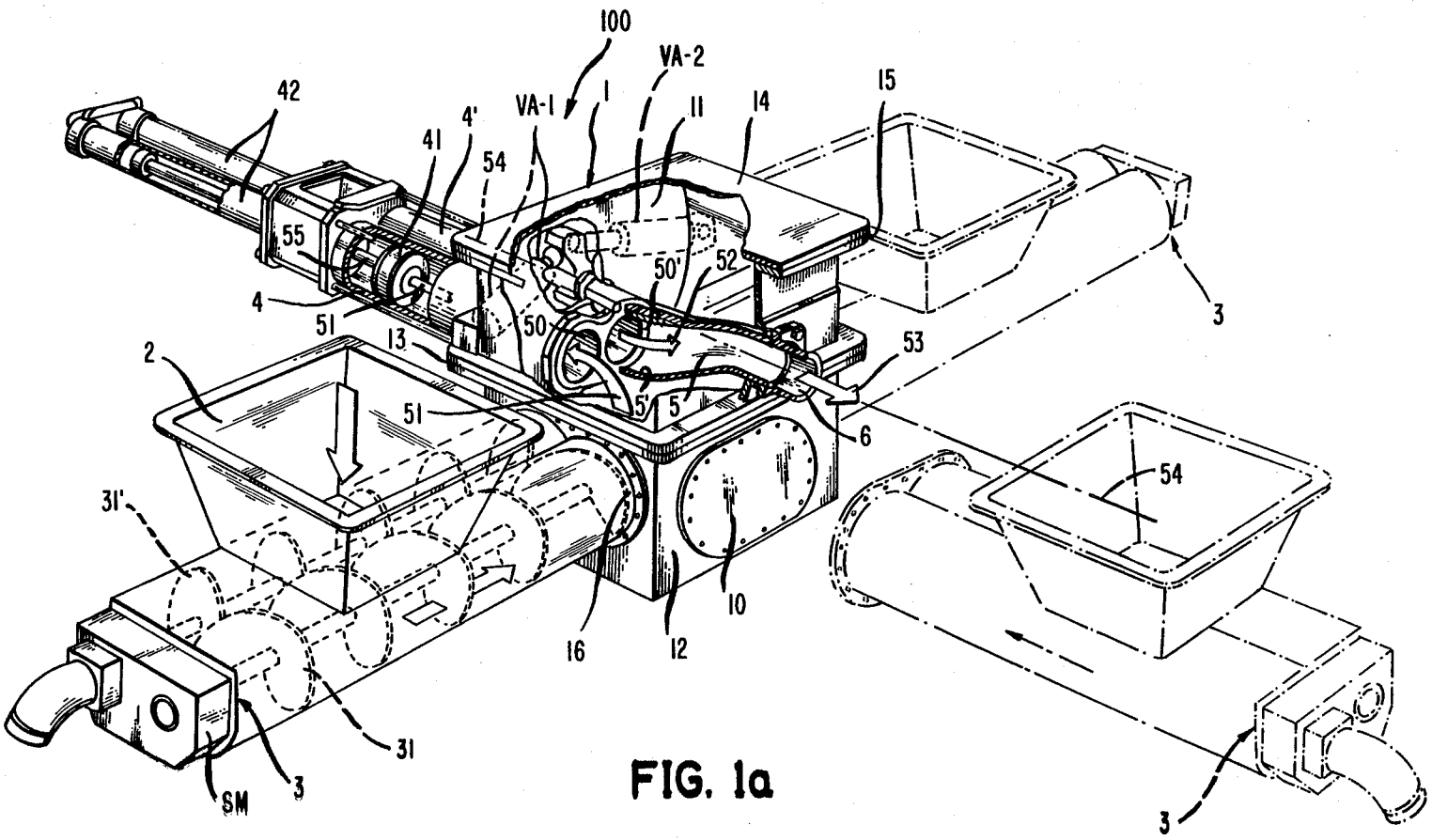
FIG. 1*a* is a modified embodiment relative to the embodiment of FIG. 1, where closable flange openings are indicated with the closure plates 10 unit directable in different directions.

In accordance with the present invention, there is provided a two-cylinder thick material pump with a pipe switch tiltably disposed in a feed chamber or hopper and alternatingly connecting the transport cylinders with a transport line and with a pre-compression unit flanged to a wall of the hopper and comprising at least one conveyor worm. The hopper is provided at several locations with openings 16, which can be covered or at which the precompression unit 3 can be flanged on as desired. The hopper can be provided with a movable cover plate.

A pipe switch is tiltably disposed in a hopper and is alternatingly connecting the transport cylinders with a transport line and with a pre-compression unit flanged to a wall of the hopper and comprising at least one conveyor worm. The pre-compression unit 3 is attached at a part 12 of the hopper 1. Said part 12 can be flanged to the other part 11 of the hopper 1 receiving the pipe switch in different directions.

The part 12 of the hopper 1 supporting the precompression unit 3 can be connected with the other part 11 receiving the pipe switch 5 via a horizontal flange. The part 12 supporting the pre-compression unit 3 can form the lower part of the hopper 1. The flange 13, connecting the two parts 11, 12 to each other, can be formed as a circle or as a square.

The hopper 1 can comprise a movable cover plate. The part 11 of the hopper 1 receiving the pipe switch 5 can comprise an upper and a lower horizontal flange, where the parts 12, carrying the pre-compression unit 3 and the cover plate 14, can be exchanged relative to the first part 11.

The thick-material pump illustrated in FIG. 1 of the drawing exhibits a hopper 1, the upper first part 11 of which is connected with the lower second part 12 by way of a flange 13 and which hopper 1 can be closed with a cover plate 14 which can be flanged at the flange 15. Two transport cylinders 4 and 4' join at the rear wall of the upper first part 11 of the hopper 1. The pistons 41 of the transport cylinders 4 and 4' can be driven by hydraulic cylinders 42 in a counter cycle. The transport cylinders can be connected alternatingly to the transport line 6 via the pipe switch 5, tiltably disposed and exhibiting an S-shaped pipe.

The numeral 100 designates a pump preferably employed according to the invention and intended for pumping freshly mixed concrete and similar heavy, viscous materials. The pump can comprise a plurality of cylinders, disposed substantially horizontally at the bottom of the machine and in side-by-side relationship. By way of illustration, the pump here illustrated is shown as having two cylinders designated by 4 and 4'. Each of the cylinders is open at its front to a hopper 1. A rotary conveyor or precompression unit 3, illustrated as a worm screw 31, is rotatably driven by a hydraulic motor SM to advance material along the trough and into the hopper 1 so that said chamber is always full of material when the machine is in operation.

Pistons 41 are reciprocable in the cylinders 4 and 4' respectively. As each piston moves rearwardly in its charging stroke, it draws material into its cylinder 4, through the open front 50 of the latter (arrow 51), from the hopper 1. When the piston moves forward in its discharging stroke, a valve or pipe switch 5, which is then in register with the front 50' of the cylinder 4', ducts material (arrow 52) expelled from the cylinder through a generally S-shaped passage 5' in the valve or pipe switch 5 to a transport line 6 (arrow 53). Hence, the valve passage 5' in effect forms a part of the transport line, and because of the shape of this passage, the valve or pipe switch 5 can be conveniently referred to as an S-valve.

The inlet of the transport line 6 is so located with respect to the cylinders that its axis and their axes define the ports of an isosceles triangle, and the S-valve is swingable about the axis 54 of the transport line 6 to a pair of defined operating positions, in each of which it is in register with the front 50' of one of the cylinders and leaves the other 50 in open communication with the interior of the hopper. It will be seen that the S-valve must always be in register with the discharging cylinder, i.e. the cylinder whose piston is moving forward, while the other cylinder is being charged from the hopper 1.

The S-valve is actuated in such swinging motion by hydraulic motor means, here shown as comprising a pair of single-acting reciprocating hydraulic actuators VA-1 and VA-2, and it will be observed that the extension of actuator VA-1 swings the S-valve into register with cylinder via 50, while extension of actuator VA-2 swings the S-valve into register with cylinder via 50'. The means by which the actuation of the S-valve is coordinated with reciprocation of pistons 41 is described in U.S. Pat. No. 3,380,388.

Each piston 41 is reciprocated by its own doubleacting hydraulic driver or cylinder 42, the rod 55 of the hydraulic cylinder being rigidly attached to the piston in its associated pump cylinder. When pressure fluid is introduced through a port in the rod or front end of the hydraulic cylinder, the associated piston is moved rearwardly in its charging stroke, and when pressure fluid is introduced into another port in the rear or head end of the hydraulic cylinder, the piston is moved forward in its expulsion or discharge stroke.

Figure 2:
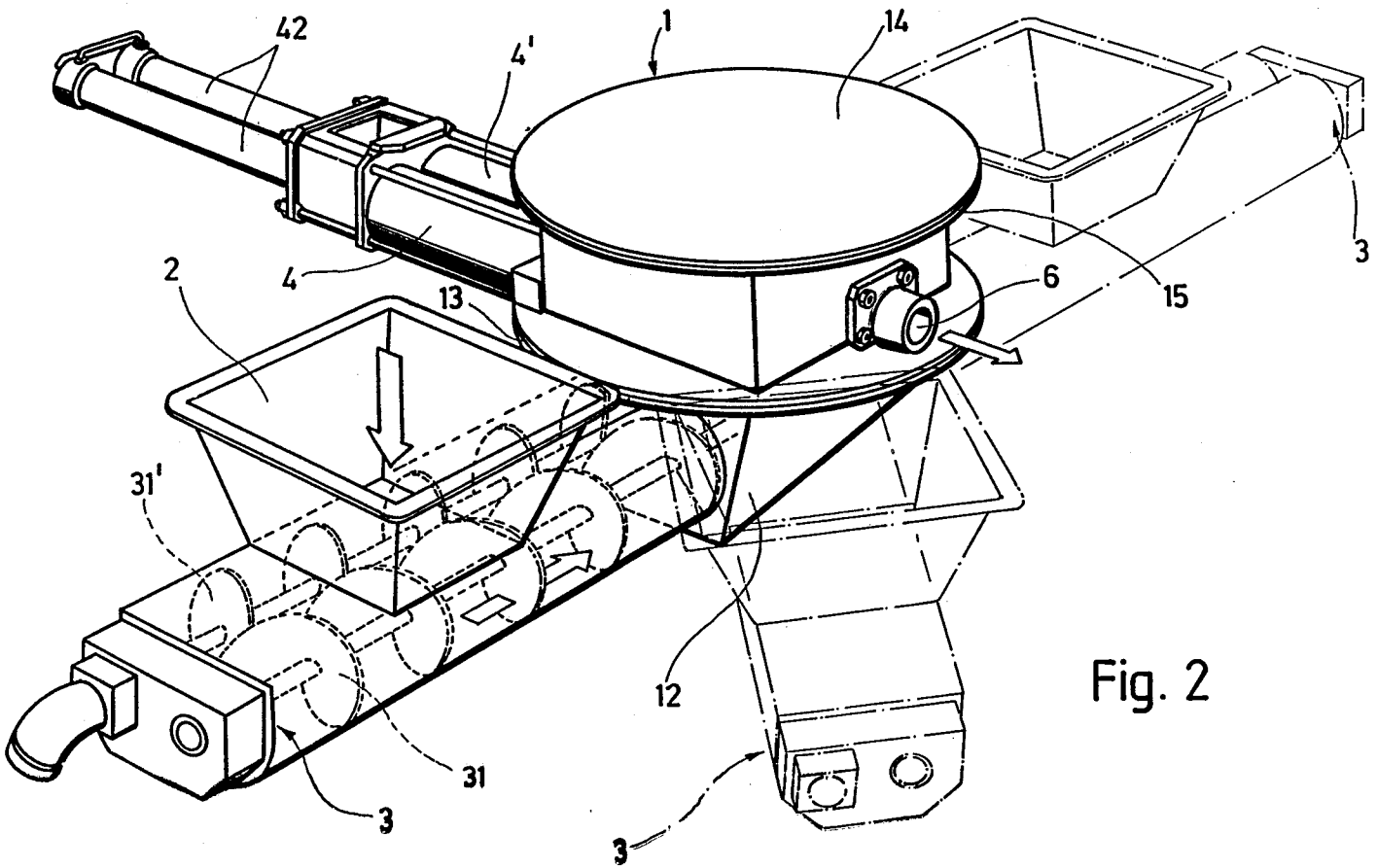
FIG. 2 is a schematic perspective view of an embodiment modified relative to that of FIG. 1 of a thick-material pump with a pre-compression unit.

The pre-compression unit 3 exhibits two conveyor screws 31 and 31' combing with each other, which screws 31 and 31' are disposed in a charging channel, which in turn is charged via a filling funnel 2 with material to be transported. The pre-compression unit 3 joins the lower second part 12 of the hopper 1. In the case of the embodiment according to FIG. 1, the flange connection 13 between the first part 11 and the second part 12 of the hopper is formed as a square such that the pre-compression unit can be placed by rotation of respectively 90 degrees into the positions represented by the dash-dotted lines. The lower flange allows to mount in 90° angle precompression augers for such industrial applications, where in-line arrangement is not possible. In case of employment of a round flange 13, according to FIG. 2, the precompression unit can be mounted and attached in any desired direction. If in case of screws, clamping connections are employed at the flange, then even a stepless rotation of the pre-compression unit is possible relative to the pump and transport cylinder 4, 4'. The FIG. 1 a is an embodiment related to the embodiment of FIG. 1, however, it illustrates the presence of closure plates 10 which are suitable for closing flange openings.

In principle, it is possible to provide several openings 16 in the embodiment according to FIG. 1 in the lower second part 12 of the hopper 1, which can be covered by suitable covers such as closure plates 10 and where the pre-compression unit 3 can be flanged on as desired.

It will be understood that each of the elements described above, or two or more together, may also find a useful application in other types of sludge pumps differing from the types described above.

While the invention has been illustrated and described as embodied in the context of a two-cylinder piston pump with a pre-compression device for concrete, slurry, and the like material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A two-cylinder, thick-material pump comprising a hopper having a wall and having several location with openings in the wall; transport cylinders connected to the hopper;

a transport line for providing pumped output;

a pre-compression unit comprising at least one conveyor worm, flanged to one of the openings in the wall of the hopper, and covers covering the other openings in the wall of the hopper; a pipe switch tiltably disposed in the hopper and alternatingly connecting the transport cylinders with the transport line and with the pre-compression unit;

the pre-compression unit being flangeable by choice to different openings in the wall of the hopper for allowing a positioning of transport cylinders and pre-compression unit at different angles relative to each other.

2. A two-cylinder, thick material pump according to claim 1 further comprising a movable cover plate attached at the hopper.

3. A two-cylinder, thick material pump comprising a hopper including a first part of the hopper and a second part of the hopper, which second part of the hopper is flanged to the first part of the hopper;

transport cylinders connected to the first part of the hopper;

a pre-compression unit attached to the second part of the hopper;

a transport line for providing pumped output;

a pipe switch tiltably disposed at the hopper, received at the first part of the hopper and alternatingly connecting the transport cylinders with the transport line and with the pre-compression unit;

the first and the second parts of the hopper being flangeable by choice in different directions to each other for allowing positioning of transport cylinders and precompression unit at different angles relative to each other.

4. A two-cylinder, thick material pump according to claim 3 further comprising a horizontal flange, wherein the second part of the hopper supporting the pre-compression unit can be connected with the first part receiving the pipe switch via the horizontal flange.

5. A two-cylinder, thick material pump according to claim 4 wherein the horizontal flange, connecting the first part and the second part to each other, is formed as a circle.

6. A two-cylinder, thick material pump according to claim 4 wherein the horizontal flange, connecting the first part and the second part to each other, is formed as a square.

7. A two-cylinder, thick material pump according to claim 3 wherein the second part supporting the precompression device forms the lower part of the hopper.

8. A two-cylinder, thick material pump according to claim 3 wherein the hopper comprises a movable cover plate.

9. A two-cylinder, thick material pump according to claim 8 wherein the first part of the hopper receiving the pipe switch comprises an upper and a lower horizontal flange, where the second part carrying the precompression unit and the cover plate can be exchanged relative to the first part as desired.

10. A two-cylinder, thick material pump with a pipe switch tiltably disposed in a hopper and alternatingly connecting transport cylinders with a transport line and with a pre-compression unit flanged to a wall of the hopper and comprising at least one conveyor worm wherein the improvement comprises that the hopper is provided at several locations with openings (16), which can be covered or at which the pre-compression unit (3) can be flanged on as desired.

11. A two-cylinder, thick material pump according to claim 10 wherein the hopper is provided with a movable cover plate.

12. A two-cylinder, thick material pump with a pipe switch tiltably disposed in a hopper and alternatingly connecting transport cylinders with a transport line and with a pre-compression unit flanged to a wall of the hopper and comprising at least one conveyor worm wherein the improvement comprises that the pre-compression unit (3) is attached at a part (12) of the hopper (1), which part can be flanged to another part (11) of the hopper (1) for receiving material from the pipe switch as connected in different directions.

13. A two-cylinder, thick material pump according to claim 12 wherein the part (12) of the hopper (1) supporting the pre-compression unit (3) can be connected with the other part (11) receiving the pipe switch (5) via a horizontal flange.

14. A two-cylinder, thick material pump according to claim 12 wherein the part (12) supporting the precompression device (3) forms the lower part of the hopper (1).

15. A two-cylinder, thick material pump according to claim 12 wherein the flange (13), connecting the two parts (11, 12) to each other, is formed as a circle.

16. A two-cylinder, thick material pump according to claim 12 wherein the flange (13), connecting the two parts (11, 12) to each other, is formed as a square.

17. A two-cylinder, thick material pump according to claim 12 wherein the hopper (1) comprises a movable cover plate.

18. A two-cylinder, thick material pump according to claim 12 wherein the other part (11) of the hopper (1) receiving the pipe switch (5) comprises an upper and a lower horizontal flange, where a lower second part (12), carrying the pre-compression unit (3) and the cover plate (14) can be substituted as desired for the part (11) by way of flanged attachment and removal.

* * * * *